US006674988B2

(12) United States Patent
Kawanishi

(10) Patent No.: US 6,674,988 B2
(45) Date of Patent: Jan. 6, 2004

(54) TONER MISREGISTRATION DETECTION SENSOR, COLOR IMAGE-FORMING APPARATUS USING THE SAME, AND METHOD FOR TONER MISREGISTRATION DETECTION

(75) Inventor: Shinya Kawanishi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 11 days.

(21) Appl. No.: 10/059,399

(22) Filed: Jan. 31, 2002

(65) Prior Publication Data

US 2002/0102114 A1 Aug. 1, 2002

(30) Foreign Application Priority Data

Jan. 31, 2001 (JP) ..... 2001-024297

(51) Int. Cl.[7] ..... G03G 15/01
(52) U.S. Cl. ..... 399/301
(58) Field of Search ..... 399/38, 39, 40, 399/41, 49, 74, 301, 297, 298; 358/504

(56) References Cited

U.S. PATENT DOCUMENTS 4,736,315 A * 4/1988 Ozaki et al. ..... 702/180
4,796,065 A 1/1989 Kanbayashi ..... 399/60
5,325,153 A * 6/1994 Mitsuse et al. ..... 399/74
5,909,235 A * 6/1999 Folkins ..... 399/372
5,953,554 A * 9/1999 Ohnishi et al. ..... 399/49
6,198,549 B1 * 3/2001 Decker et al. ..... 358/504

FOREIGN PATENT DOCUMENTS

| | | |
|---|---|---|
| JP | 62-209476 | 9/1987 |
| JP | 63-279276 | * 11/1988 |
| JP | 63-304281 | 12/1988 |
| JP | 9-89769 | 4/1997 |
| JP | 10-62340 | 3/1998 |
| JP | 10-186827 | 7/1998 |
| JP | 11-84768 | 3/1999 |

* cited by examiner

*Primary Examiner*—Hoan Tran
(74) *Attorney, Agent, or Firm*—Birch, Stewart, Kolasch & Birch, LLP

(57) ABSTRACT

Infrared light emitted from an infrared light-emitting diode and reflected by a toner that is an object to be detected. Then, the reflection light is received by a photodiode. A signal detection circuit is composed of an amplifier for converting an output current into a voltage, an amplifier in which a circuit constant is optimized for detection of color toner density, an amplifier in which a circuit constant is optimized for detection of black toner density and an amplifier in a circuit constant is optimized for detection of toner misregistration. These amplifiers are connected to each other in two steps. The first step amplifier's output is further amplified by the second step amplifiers to output as a color toner detection output voltage Vo1, a black toner detection output voltage Vo2, and a toner misregistration detection output voltage Vo3.

28 Claims, 4 Drawing Sheets

TONER MISREGISTRATION DETECTION SENSOR, COLOR IMAGE-FORMING APPARATUS USING THE SAME, AND METHOD FOR TONER MISREGISTRATION DETECTION

BACKGROUND OF THE INVENTION

1. Field of the Invention

The present invention relates to a toner density and toner misregistration detection sensor for use in image formation of color image forming apparatuses such as a color copier and a color printer, and a color image forming apparatus using the same, and to a method for toner misregistration detection.

2. Description of the Related Art

Conventionally, a color image forming apparatus such as a color copier or a color printer is provided with a toner density detection sensor and a toner misregistration detection sensor separately. The toner density detection sensor is disclosed, for example, in Japanese Unexamined Patent Publications JP-A 9-89769 (1997), JP-A 10-62340 (1998), JP-A 10-186827 (1998), and JP-A 11-84768 (1999). The toner density detection disclosed in the publications is performed based on a difference in reflection rate resulting from irradiating toner with infrared light.

A toner misregistration detection sensor, as shown in FIG. 7A, utilizes as a light source 21 an LED in which a light pencil is narrowed by a laser or lens. The detection by the toner misregistration detection sensor is performed in such a manner that a photosensitive drum 30 is irradiated with collimated light. The photosensitive drum 30 is thereby rotated at uniform rotating speed, and reflection light reflected from each of yellow (Y) toner, magenta (M) toner, cyan (C) toner, and black (K) toner is detected by a light receiving element 22 to detect a toner misregistration by measuring time intervals between detections of the reflection light from the respective toners.

A toner misregistration sensor 20 as shown in FIG. 7A, for example, measures a time interval t1 between detection of reflection light from Y toner and detection of reflection light from K toner, a time interval t2 between detection of reflection light from M toner and detection of reflection light from K toner, and a time interval t3 between detection of reflection light from C toner and detection of reflection lights of K toner, as shown in FIG. 7B, thereby detecting Y toner, M toner, and C toner misregistrations with reference to K toner position. When the time interval t1 between the detection of the Y toner reflection light and the detection of the K toner reflection lights is longer than a predetermined value, the Y toner deviates from the K toner. When the time interval t2 between the detections of the M toner and K toner reflection lights is shorter than a predetermined value, the M toner deviates from the K toner. Furthermore, according to a difference between the time interval t1 and the time interval t2, a toner misregistration between the Y toner and the M toner can be detected. In this way, toner misregistration can be detected in accordance with differences between the time intervals between the detections of reflection light from the respective Y, M, and C toners and the detection of reflection light from the K toner.

The conventional toner density sensor detects only toner densities. Further, the conventional toner misregistration sensor detects only toner misregistrations. Therefore, in order to detect toner densities and toner misregistrations, two sensors such as a toner density sensor and a toner misregistration sensor are necessary. Therefore, there arises a problem that costs of the color image forming apparatus increases and sufficient space is necessary in the color image forming apparatus to arrange these two sensors therein.

SUMMARY OF THE INVENTION

It is an object of the invention to provide a toner misregistration detection sensor, capable of detection of both toner density and toner misregistration with a signal detected by one light emitting element and one light receiving element, a color image forming apparatus provided with the same, and a method for toner misregistration detection.

The invention relates to a toner misregistration detection sensor for use in a color image forming apparatus, comprising:

- a light emitting element for irradiating a predetermined area on an object to be detected with light;
- a light receiving element for receiving reflection light which is emitted from the light emitting element and reflected on a surface of the object to be detected;
- toner density detection means for detection of toner density based on a signal outputted from the light receiving element; and
- toner misregistration detection means for detection of toner misregistration based on a signal outputted from the light receiving element.

According to the invention, the detection functions of a toner density detection means and a toner misregistration detection means are performed based on signals from a light receiving element which receives light which is emitted from a light emitting element and is reflected on a surface of an object to be reflected. Therefore, the space occupied by the such a sensor can be smaller in comparison with that occupied with different sensors for detection of toner density and toner misregistration, with the result that cost reduction can be achieved.

In the invention, it is preferable that the toner misregistration detection means detects a misregistration of each of the yellow toner, magenta toner and cyan toner to the black toner.

According to the invention, the toner misregistration detection means utilizes the difference in the reflection rate of light between color toners such as yellow, magenta and cyan, and a black toner, thereby detecting a misregistration of each of the color toners to the black toner.

In the invention, it is preferable that the toner misregistration detection means detects a misregistration of a pattern of each of yellow toner, magenta toner and cyan toner, to a pattern of black toner.

According to the invention, the toner misregistration detection means can detect misregistration of the respective color toners to the black toner from their patterns.

In the invention, it is preferable that the toner misregistration detection means detects a misregistration of a pattern of each of yellow toner, magenta toner and cyan toner to a pattern of black toner which are placed so as to be misregistered from each other by half of a width of either of the patterns.

According to the invention, the toner misregistration detection means can detect a misregistration of a pattern of each of yellow toner, magenta toner and cyan toner to a pattern of black toner which are disposed so as to be misregistered from each other by half of a width of either of the patterns.

In the invention, it is preferable that the toner misregistration detection means detects a misregistration of a pattern of each of yellow toner, magenta toner and cyan toner to a pattern of black toner, which patterns are disposed so as to form stripes arranged at regular intervals.

According to the invention, since the toner misregistration detection means detects a misregistration of a pattern of each of yellow toner, magenta tone and cyan toner to a pattern of black toner which patterns are disposed so as to form stripes arranged at regular intervals, the toner misregistration detection means can easily detect the direction of the misregistration.

In the invention it is preferable that the toner misregistration detection means detects a misregistration of a pattern of each of yellow toner, magenta toner and cyan toner to a pattern of black toner which is disposed so as to overlap part of the pattern of each of the color toners.

According to the invention, the black toner pattern is disposed so as to overlap part of each of the color toner patterns, thus, the toner misregistration detection means can detect a misregistration of the color toner pattern to the black toner pattern.

In the invention it is preferable that the toner misregistration detection means detects a misregistration of a pattern of each of yellow toner, magenta toner and cyan toner to a pattern of black toner which is disposed so as to be partly overlapped by the pattern of each of the color toners.

According to the invention, since the black toner pattern is disposed so as to be partly overlapped by each of the color toner patterns, the toner misregistration detection means can detect misregistrations of the color toner patterns to the black toner pattern.

In the invention it is preferable that feedback of an output from the toner density detection means is carried out to an output from the toner misregistration detection means.

According to the invention, feedback of a detection result of toner density by the toner density detection means is carried out to the toner misregistration detection means, whereby toner densities of toner misregistration detection patterns can be made proper and as a result the detection by the toner misregistration detection means can be performed with high accuracy.

In the invention it is preferable that a signal processing circuit constituting the toner density detection means and the toner misregistration detection means is composed of two amplifiers, one of which is a first step amplifier using a CMOS operation amplifier and the other is a second step amplifier using a bipolar operation amplifier, and the first step amplifier is provided with a sensitivity adjustment volume.

According to the invention, the signal processing circuit constituting the toner density detection means and the toner misregistration detection means is composed of two amplifiers, one of which is a first step amplifier using a CMOS in which an output signal outputted from the light receiving element is not consumed as an input bias current and the other is a second step amplifier using a bipolar operation amplifier having a small input offset voltage. By using the two step amplifiers, an error in the signal detection circuit can be minimized. Further, the first step amplifier is provided with a sensitivity adjustment volume, thereby the variation in signals outputted from the light receiving element can be controlled.

In the invention, it is preferable that a constant voltage circuit is provided to supply standard voltages to the first step amplifier and the second step amplifier.

According to the invention, since the standard voltages of the first step amplifier and the second step amplifier are supplied from the constant voltage circuit, an influence exerted on the output from the sensor can be controlled by the variation in power voltage.

In the invention, it is preferable that the light emitting element is composed of a light-emitting diode, whose anode is connected to a driving power, and whose cathode is connected to a connector provided for controlling a current.

According to the invention, since it is possible to externally vary and control flowing current according to variation of light amount of the light-emitting element, it is possible to obtain characteristics that are not influenced by the variation of light amount of the light-emitting element.

In the invention, it is preferable that the toner misregistration detection sensor comprises:

one light emitting element for irradiating a predetermined area on an object to be detected with light; and one light receiving element for receiving reflection of light which is emitted from the light-emitting element and is reflected by a surface of the object to be detected, wherein axes of the elements intersect each other at a point on an object to be detected, and wherein the light-receiving element is located at a position where a mirror reflected component of the light which is emitted from the light-emitting element and reflected by a surface of the object to be detected is not received.

According to the invention, since a light-receiving element receives only the light which is diffused and reflected by toner adhered to the object to be detected without receiving the light which is emitted from the light-emitting element and is mirror-reflected by the surface of the object to be detected, for example, in the case of employing infrared light for a light emitting element, densities of the black toner, which has low reflection rate with respect to the diffusing and reflecting light, and of the color toner, which has high reflection rate with respect to the infrared light, and a position error (a misregistration) can be detected with high accuracy.

In the invention, it is preferable that the toner misregistration detection sensor comprises:

one light emitting element for irradiating a predetermined area on an object to be detected with light; and two light receiving elements for receiving reflection of light which is emitted from the light-emitting element and is reflected on a surface of the object to be detected, wherein axes of the elements intersect each other at a point on an object to be detected, and wherein one of the light-receiving elements is located at a position where a mirror reflected component of the light which is emitted from the light-emitting element and reflected on a surface of the object to be detected is not received and the other of the light-receiving elements is located at a position where a mirror reflected component of the light which is emitted from the light-emitting element and reflected on a surface of the object to be detected is received.

According to the invention, since the light-receiving element receives a light which is irradiated from the light-emitting element and is diffused and reflected or mirror reflected by toner adhered to a surface of the object to be detected, for example, in the case where toner adhered to the transfer medium (intermediate transferring body) in a black belt-shape is detected by using infrared light for a light-emitting element, densities of the color toners having high reflection rate, and of the black toner adhered to the transfer medium in a black belt-shape, and the toner misregistration can be detected with high accuracy.

The invention provides a color image forming apparatus using the toner misregistration detection sensor.

According to the invention, the color image forming apparatus is composed of the toner misregistration detection sensor, and thereby an image in which colors are well reproduced and formed without toner misregistration.

The invention provides a method for detection of toner misregistration for use in a color image forming apparatus, comprising:

disposing a pattern of a toner of each color of yellow, magenta and cyan and a pattern of black toner so as to partly overlap each other;

irradiating the patterns with light; and detecting a misregistration of one to the other of patterns based on an amount of light received.

According to the invention, the black toner pattern and the respective color toner patterns are disposed so as to partly overlap each other, and the patterns are irradiated with light by e.g., a light emitting element. Based on the amount of light received by e.g., a light receiving element, a misregistration of one to the other of the patterns can be easily detected. Furthermore, as the light irradiated to the pattern is not used collimated light such as laser light, but light which spreads out may be used and misregistration detection can be performed using such a light, with the result that cost reduction can be achieved.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
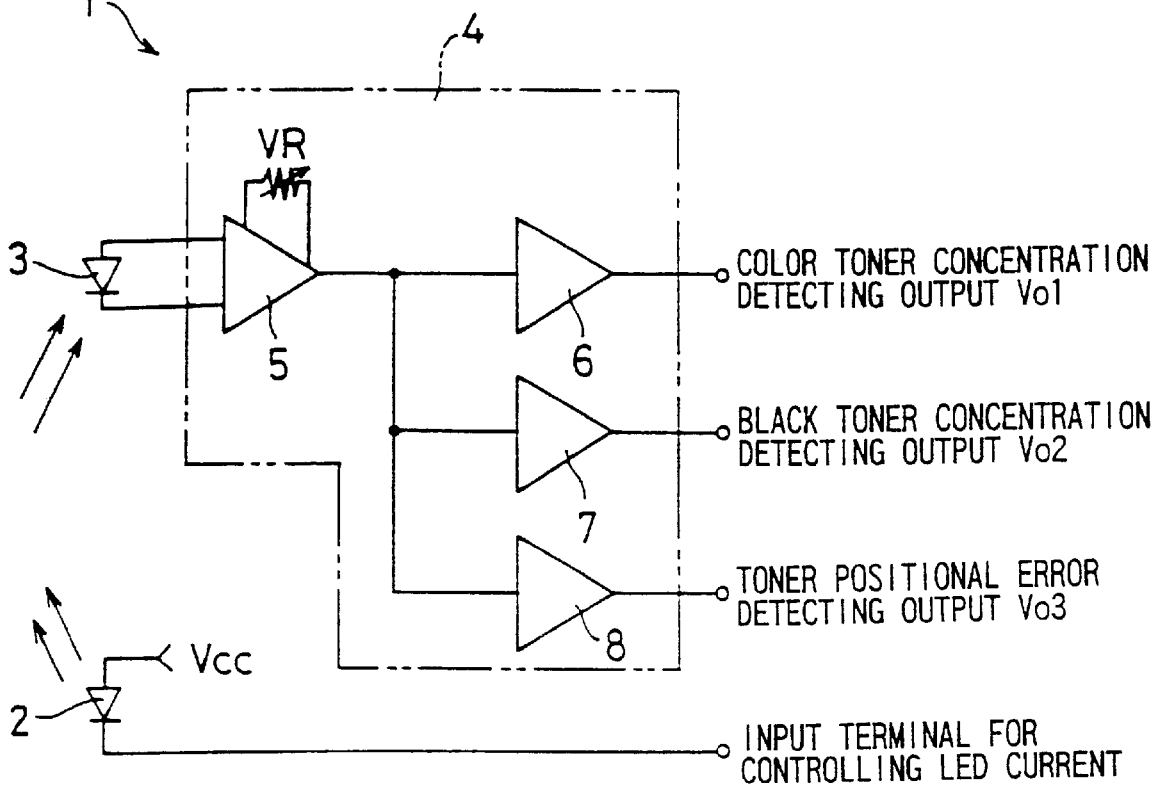
FIG. 1 is a block diagram showing an electrical constitution of a toner misregistration detection sensor 1 of an embodiment of the invention.

Now referring to the drawings, preferred embodiments of the invention are described below.

FIG. 1 is a block diagram showing an electrical constitution of a toner misregistration detection sensor 1 of one embodiment of the invention. The sensor comprises an infrared light-emitting diode (LED) 2 as a light-emitting element, a photodiode (PD) 3 as a light receiving element, and a signal processing circuit 4 which processes an output from the light receiving element.

Infrared light which is emitted from the infrared light-emitting diode 2 and is reflected on the toner that is an object to be detected. Then, the reflection light is received by the photo diode 3. The photo diode 3 outputs a current depending upon the amount of the light received and the output is processed through the signal detection circuit 4.

The signal processing circuit 4 is composed of multistage amplifiers which are connected to each other, and has a current voltage conversion portion and a voltage amplifier portion. A first step amplifier 5 functions as a current voltage conversion portion to convert an output current from the photodiode 3 into a voltage. In the case of detection of black toner density, since the reflection rate of light reflected from the black toner becomes small, the output current of the photodiode 3 also becomes small. Therefore, if an input bias current of the first step amplifier 5 becomes large, part of the output current of the photodiode 3 is consumed as an input bias current of the amplifier, so that an error is caused at the time of current-voltage conversion. Therefore, for the first step amplifier 5 is used a CMOS operation (Complementary Metal Oxide Semiconductor) amplifier having a small input bias current instead of a bipolar operation amplifier having a large input bias current. Recently, in addition to the CMOS operation amplifier, FET (Field Effect Transistor) operation amplifiers having a small input bias current equal to the CMOS operation amplifier have been developed. Therefore, such an operation amplifier may be used as the first step amplifier 5.

The output voltage outputted from the first step amplifier 5 is inputted to second step amplifiers 6, 7, and 8 functioning as a voltage amplifier portion. The second step amplifier 6 is an amplifier in which a circuit constant is optimized for detection of color toner density. The second step amplifier 7 is an amplifier in which a circuit constant is optimized for detection of black toner density. The second step amplifier 8 is an amplifier in which a circuit constant is optimized for detection of toner misregistration. The output voltage outputted from the first step amplifier 5 is further amplified by these second step amplifiers 6, 7 and 8, and outputted as output voltages Vo1 (color toner detection output), Vo2 (black toner detection output) and Vo3 (toner misregistration detection output).

According to the embodiment of the invention, bipolar operation amplifiers are used for the second step amplifiers 6, 7, and 8. This is because an input bias current to the second step amplifiers 6, 7, and 8 has little effect on the output voltages Vo1, Vo2, and Vo3 since a CMOS operation amplifier having low output impedance is used for the first step amplifier 5, and because taking the fact into the consideration that the input offset voltage from the second step amplifiers is amplified and thereby causes an error in output, a bipolar operation amplifier having smaller input offset voltage in comparison with a CMOS, is preferably used for the second step amplifiers 6, 7 and 8 in order to reduce an error in output voltage.

The first step amplifier 5 is provided with a sensitivity adjustment volume VR. There are variations in the amount of light emitting from the infrared light-emitting diode 2 from sample to sample and product to product. In the same way, there are variations in sensitivity of the photodiode 3 from sample to sample and product to product. Therefore, when the infrared light emitting-diode 2 and the photodiode 3 having such variations are used for the toner misregistration detection sensor 1 according to the invention, there are variations between the maximum output current and the minimum output current of the output current of the photodiode 3 by many times. As a result, a wide range of variation is observed from product to product. In this case, by controlling the sensitivity adjustment volume VR, it is possible to eliminate the variation in the output of the toner misregistration detection sensor 1 as a product.

The first step amplifier 5 functioning as a current voltage conversion portion and the second step amplifiers 6, 7, and 8 functioning as an amplifier circuit portion need different standard voltages. In the case that the standard voltage is changed by variations in the power voltage, it has an effect on the output voltages Vo1, Vo2, and Vo3. To avoid the effect on the output voltages Vo1, Vo2, and Vo3, it is preferable that a constant-voltage circuit having no effect caused by the power voltage variation, is provided using a regulator, and the standard voltage is determined for respective amplifiers by use of the circuit output voltage.

Figure 2:
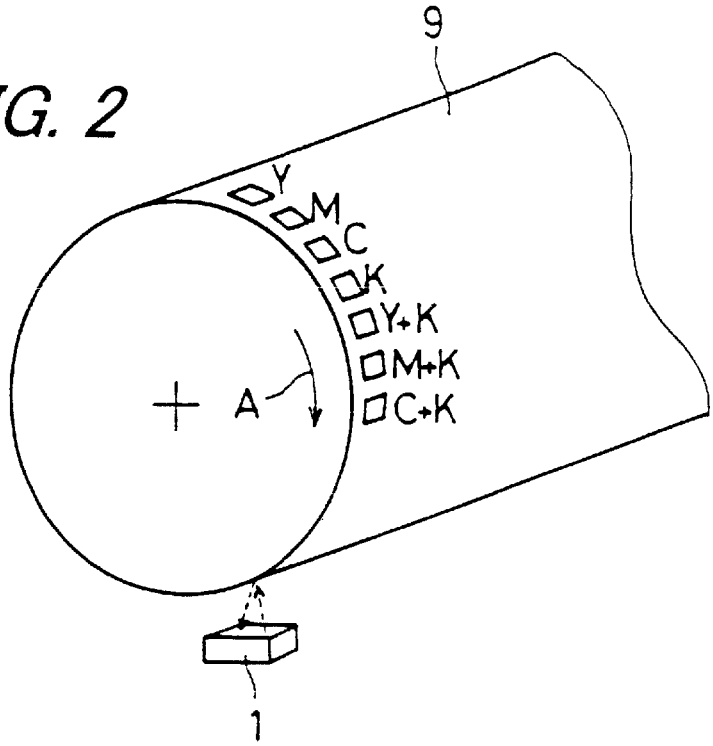
FIG. 2 is a schematic sectional view of a toner misregistration detection sensor 1.

Next, a method for detection of toner misregistration will be described using the toner misregistration detection sensor 1. The sensor 1 is applied to a color image forming apparatus. FIG. 2 is a view showing one example toner density detection pattern and one example of a toner misregistration detection pattern, which is formed on a photosensitive member (a photosensitive drum) 9, and showing an arrangement of the toner detection sensor 1. The photosensitive member 9 is a cylindrical-shape and rotates about the axis of rotation in the direction of an arrow A shown in FIG. 2. The toner density detection pattern and the toner misregistration detection pattern are formed at the edge portion of the photosensitive member 9, in other words, at the outside of the image formation region. The toner misregistration detection sensor 1 is located so that infrared light which is irradiated from the infrared light-emitting diode 2 is received by the toner density and toner misregistration detection patterns, which are formed on the photosensitive member 9, and the reflection light reflected from the above mentioned patterns is received by the photodiode 3.

Figure 3:
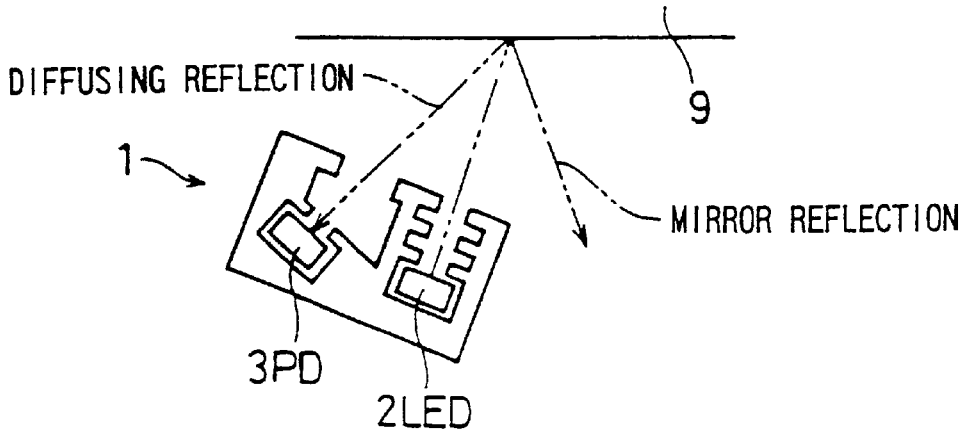
FIG. 3 is a view showing one example pattern for detection of toner density and toner misregistration, which is formed on a photosensitive member 9 (a photosensitive drum) of a color image forming apparatus, and an arrangement of a toner misregistration detection sensor 1.

FIG. 3 is a schematic cross sectional view of the toner misregistration detection sensor 1. The infrared light-emitting diode 2 and the photodiode 3 are arranged in order that their respective optical axes intersect each other at a point on the surface of the photosensitive member 9. Moreover, the photodiode 3 is located in a place receiving only a diffused and reflection light without receiving a mirror-reflected light which is irradiated from the infrared light-emitting diode 2 and is mirror-reflected on the photosensitive member 9 or the toner formed on the photosensitive member 9. By adopting this, the toner density and the toner misregistration can be detected with high accuracy.

The toner density detection pattern is formed with separate toner patterns of four colors such as Y (yellow), M (magenta), C (cyan), and K (black). According to the toner misregistration detection sensor 1, the photosensitive member 9 is irradiated with infrared light which is irradiated from the infrared light-emitting diode 2, and the reflection light reflected by the toner adhered to the photosensitive member 9 is received by the photodiode 3. As the amount of the color toner adhered to the photosensitive member 9 (color toner density) increases, the amount of a mirror-reflected light which is reflected by a surface of the photosensitive member 9 decreases. However, the reflection rate of the infrared light which is reflected on each color toner is larger than that of the infrared light which is reflected by the surface of the photosensitive member 9. Accordingly, if the amount of each color toner adhered to the photosensitive member 9 increases, the amount of the infrared light which is diffused and reflected, increases. As opposed to the color toner, if the amount of the black toner adhered to the photosensitive member 9 increases, the amount of the infrared light which is diffused and reflected, decreases. According to this, an output voltage corresponding to the toner density can be obtained from the reflection light which is reflected by the patterns for detection of toner density of these four colors, thereby the toner density can be detected.

As the toner misregistration detection patterns, three color toner patterns and black toner pattern are respectively superimposed so as to form a pattern (Y+K) formed by superimposing Y toner pattern upon K toner pattern, a pattern (M+K) formed by superimposing M toner pattern upon K toner pattern, and a pattern (C+K) formed by superimposing C toner pattern upon K toner pattern, in the same area.

Figure 4:
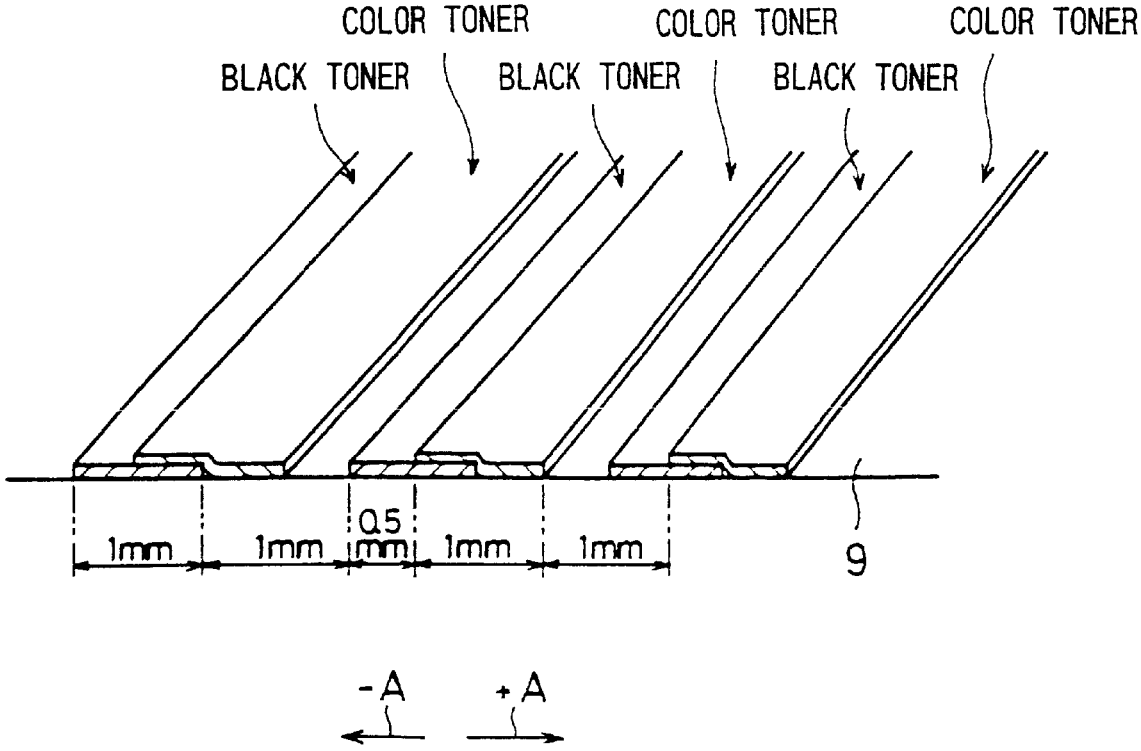
FIG. 4 is a perspective view showing a pattern for toner misregistration detection.

FIG. 4 is an enlarged perspective view of the toner misregistration detection pattern. According to the toner misregistration detection pattern of the embodiment, black toner lines, as black toner pattern, each having a width of 1 mm are arranged in a stripe shape at intervals of 1 mm. In the same way, color toner lines, as color toner pattern, each having a width of 1 mm are arranged in a stripe shape at intervals of 1 mm. These black toner and color toner patterns are formed in parallel to a rotation axis of the photosensitive member 9, and in more detail, half of the pattern width of the color toner patterns is overlaid on the black toner pattern, that is to say, part of one stripe line of each color toner is overlaid on a half of one stripe line formed by the black toner.

When the toner misregistration detection pattern shown in FIG. 4 is viewed from the side of the toner misregistration detection sensor 1 placed so as to confront the photosensitive member 9, a color toner having a width of 1 mm, black toner having a width of 0.5 mm, and the photosensitive member 9 having a width of 0.5 mm are observed. The above mentioned state is used as the reference. As the position of the color toner pattern is shifted in the direction of an arrow +A shown in FIG. 4 (rotating direction A of the photosensitive member 9) with respect to the position of the black toner pattern, the width of the black toner increases to more than 0.5 mm and the width of the photosensitive member 9 decreases to less than 0.5 mm. As the position of the color toner pattern is shifted by 0.5 mm in the direction of the +A, the black toner has a width of 1 mm and the color toner also has a width of 1 mm, so that the width of the photosensitive member becomes 0 mm. On the other hand, as the position of the color toner pattern is shifted from the standard position in the direction of an arrow −A (opposite direction to the rotating direction A of the photosensitive member 9) with respect to the position of the black toner pattern, the width of the black toner decreases to less than 0.5 mm and the width of the photosensitive member 9 increases to more than 0.5 mm. When the position of the color toner pattern is shifted in the direction of −A by 0.5 mm, the width of the black toner is 0 mm, the width of the color toner is 1 mm, and the width of the transferring body is 1 mm. As mentioned above, the position of the color toner pattern is shifted with respect to the position of the black toner pattern, thereby increasing and decreasing the width of the black toner as well as the width of the photosensitive member 9.

Figure 5:
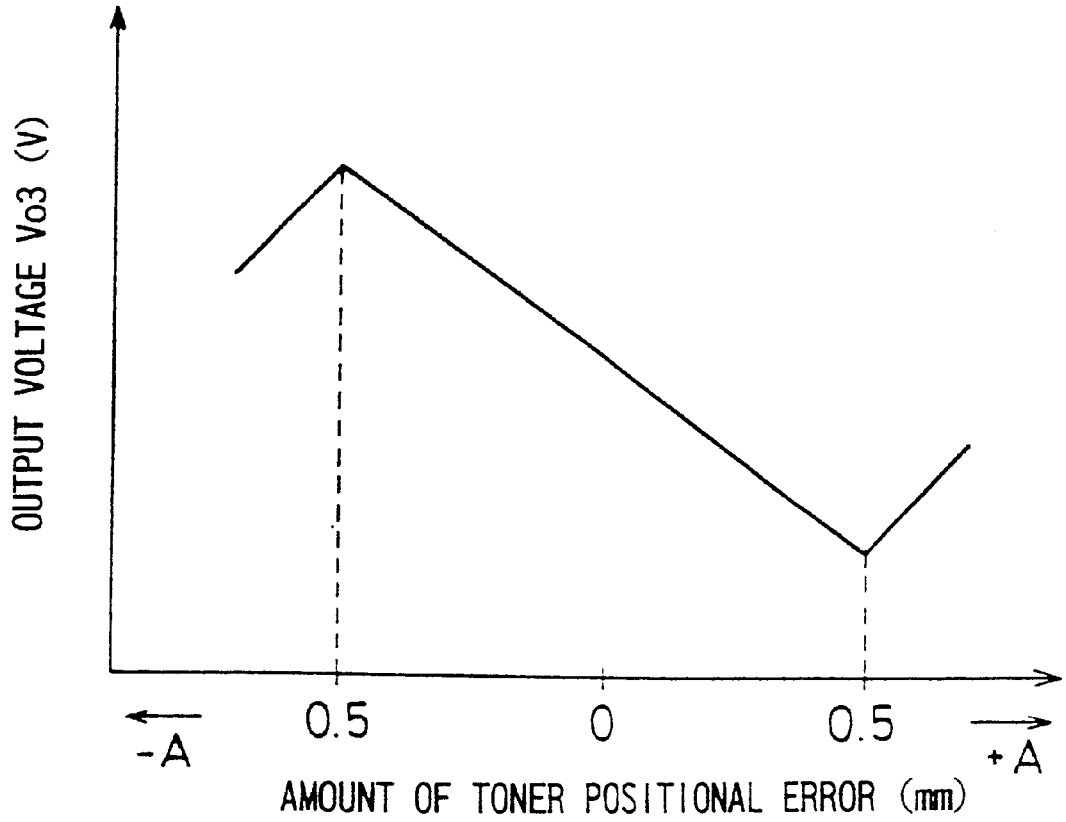
FIG. 5 is a graph showing output voltage Vo3 resulting from toner misregistration detection.

FIG. 5 is a graph showing output voltage Vo3 resulting from toner misregistration detection of the patterns. In a vicinity of the wavelength $\lambda$=950, which is a light-emitting wavelength of the infrared light-emitting diode 2, the reflection rate of the black toner is of the lowest value, not more than 10%. Further, the reflection rate of the photosensitive member 9 is about 50%, and respective reflection rates of color toners Y, M, and C are the same value, not-less than 90%.

When the toner misregistration of the color toner pattern relative to the black toner pattern is within the range from 0 to 0.5 mm in the direction of +A, the width of the black toner increases and the width of the photosensitive member 9 decreases according to the toner misregistration. Therefore, as the toner misregistration of the color toner pattern increases with respect to the light receiving amount of the photodiode 3 at the reference, the light receiving amount of the photodiode 3 decreases and the output voltage Vo3 drops. Then, the toner misregistration of the color toner pattern shows a minimum value, 0.5 mm in the direction of +A. When the amount of toner misregistration of the color toner pattern in the direction of +A exceeds 0.5 mm, the width of the black toner again turns to decrease lower than 1 mm, thereby the output voltage Vo3 turns to increase.

In the same way, when the toner misregistration of the color toner pattern relative to the black toner pattern is within the range from 0 to 0.5 mm in the direction of −A, the width of the black toner decreases and the width of the photosensitive member 9 increases according to the toner misregistration. Therefore, as the toner misregistration of the color toner pattern increases with respect to the amount of light received by the photodiode 3 at the reference, the light receiving amount of the photodiode 3 increases and the output voltage Vo3 increases. Then, the toner misregistration of the color toner pattern shows a maximum value, 0.5 mm in the direction of −A. When the amount of toner misregistration of the color toner pattern in the direction of −A exceeds 0.5 mm, the width of the black toner again turns to increase more than 0 mm, thereby the output voltage Vo3 again turns to decrease.

For example, when the toner misregistration of the color toner pattern relative to the black toner pattern of 0.6 mm is shown in the direction of +A, an output voltage reaches the output voltage Vo3 in the case where a toner misregistration of 0.4 mm is shown in the direction of −A, so that it is impossible to discriminate between the toner misregistration of 0.6 mm in the direction of +A and the toner misregistration of 0.4 mm in the direction of −A. Therefore, the detectable range of the toner misregistration of the color toner pattern relative to the black toner pattern is within the range of 0.5 mm in both directions of +A and −A.

According to the embodiment of the invention, the line width of the black toner and intervals thereof, and the line width of the color toner and intervals thereof have 1 mm, respectively. Then, the color toner is superimposed on the black toner by 0.5 mm. It should be noted that the line widths of the black toner and the color toner, and the intervals of the line widths may be optimally designed in accordance with the estimated toner misregistration.

In this way, when the amount of the toner misregistration of each color toner pattern of Y, M, and C with reference to the black toner pattern is detected in advance, for example, the detection result such that the Y toner pattern is shifted by 2 mm in the direction of +A with reference to the black toner pattern, is observed. In the above case, the Y toner is adhered with a positional correction of 0.2 mm in the direction of −A at the time of making copies of an original document, thereby enabling to make copies with no toner misregistration between the y toner and the black toner. Further, the above description relates to the toner misregistration detection in the direction of (+A direction and −A direction) the photosensitive member 9. In addition to this, it is possible to detect the toner misregistration of the photosensitive member 9 in the longitudinal direction by rotating 90° the stripe shaped pattern for detection of toner misregistration described above and forming the pattern (Y+K) formed by superimposing Y toner pattern upon K toner pattern, the pattern (M+K) formed by superimposing M toner pattern upon K toner pattern, and the pattern (C+K) formed by superimposing C toner pattern upon K toner pattern in which the direction of the stripe is parallel to a peripheral direction of the photosensitive member 9.

Moreover, according to the embodiment, a toner misregistration detection pattern is formed by superimposing a color toner pattern on the black toner pattern. Inversely, toner misregistration detection can be carried out by patterns formed by superimposing the black toner pattern on a color toner pattern.

When the amount of emitted light of the infrared light-emitting diode 2 varies depending upon the surrounding temperature or secular changes, an influence is exerted on the detection outputs of the color and black toner densities Vo1 and Vo2, and the detection output of the toner misregistration of the toner Vo3. To avoid the influence on the detection result caused by the variations in the amount of emitted light of the infrared light-emitting diode 2, the photosensitive member 9 with no adhesion of the toner is irradiated with infrared light and the amount of the reflection light reflected from the photosensitive member 9 is measured. Then, to keep the output at that time a constant value, a current passed through the infrared light-emitting diode 2 is controlled, and the toner density and the toner misregistration of the toner may be detected using the controlled infrared light-emitting diode 2. An anode of the infrared light-emitting diode 2 is connected to the power voltage and cathode may be an external terminal with a connector, in order that the current passed through the infrared light-emitting diode 2 is controlled from the outside of the toner misregistration detection sensor 1. The external terminal is connected to the current control apparatus, thereby the output of the infrared light-emitting diode 2 is easily adjusted.

Further, if there is such decision that Y toner is of high density or M toner is of low density, for example, according to the detection outputs of toner density Vo1 and Vo2, the proper amount of the toner can be adhered by feedback at the time of making copies. Namely, an image of the Y toner is formed on the photosensitive member 9 with decreasing the potential of the photosensitive member 9, and an image of the M toner is formed on the photosensitive member 9 with increasing the potential of the photosensitive member 9, so that the M toner and the Y toner are adhered to the photosensitive member 9. However, if the toner density is varied and not kept at a proper value, it exerts an influence upon the detection result of the toner position. To avoid this, after detection of toner density, feedback of the result is carried out to keep the toner density at a proper value when forming a toner misregistration detection pattern, thereby the toner misregistration can be detected with high accuracy.

The toner density and the toner misregistration of the toner formed on the photosensitive member 9 in a color image forming apparatus can be detected with respect to Y, M, C and K, respectively, by use of an optical system in which infrared lights irradiated from the above mentioned infrared light-emitting diode 2 are diffused and reflected on the photosensitive member 9 or the toner, and the lights are received. In the color image forming apparatus using a transfer medium (intermediate transfer body) in a black belt-shape, in the case that the density and the toner misregistration of the toner adhered to the transfer medium in a black belt-shape are detected, it is difficult to discriminate between the K toner and the transfer medium in a black belt-shape by use of the optical system receiving the diffusing and reflecting light. In this case, color toners of Y, M, and C are detected by use of the optical system receiving a diffusing and reflecting light, and then a K toner density is detected by use of an optical system in which an infrared light-emitting diode and a light receiving element are located on a mirror-reflected place, thereby the toner can be detected with high accuracy.

Figure 6:
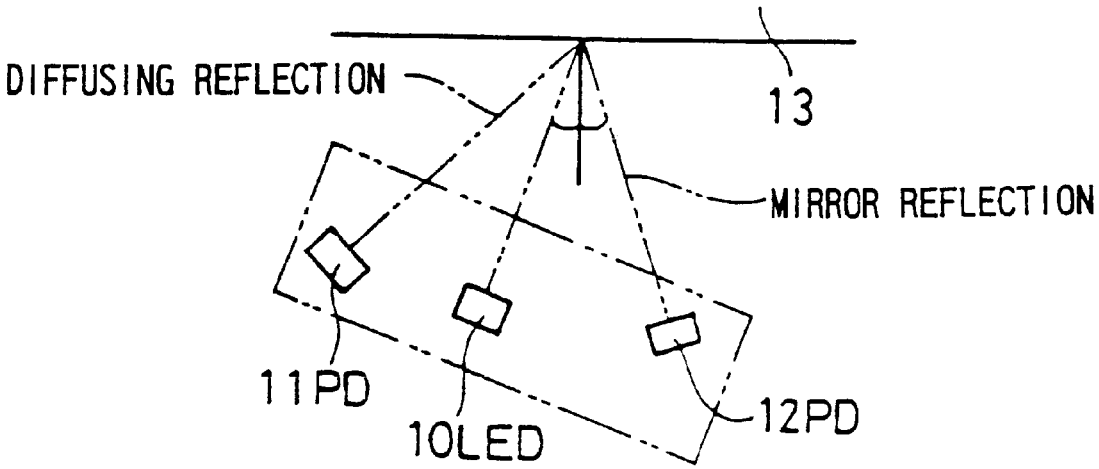
FIG. 6 is a view showing the location relationship between light-emitting element and light-receiving elements of a toner misregistration detection sensor in the case of detecting a toner formed on a black belt shaped transfer medium.
Figure 7A:
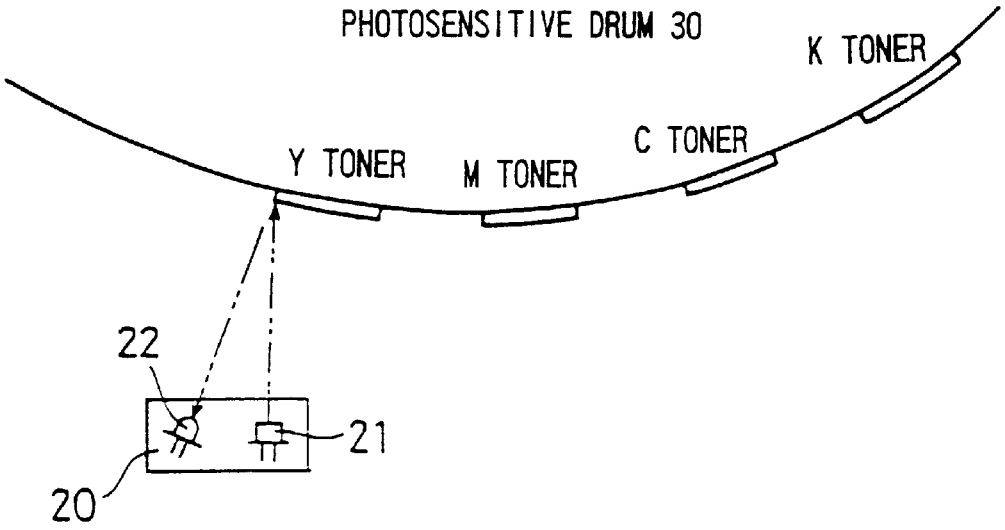
FIG. 7A PRIOR ART
FIGS. 7A and 7B are views showing a conventional method for detection of toner misregistration.
Figure 7B:
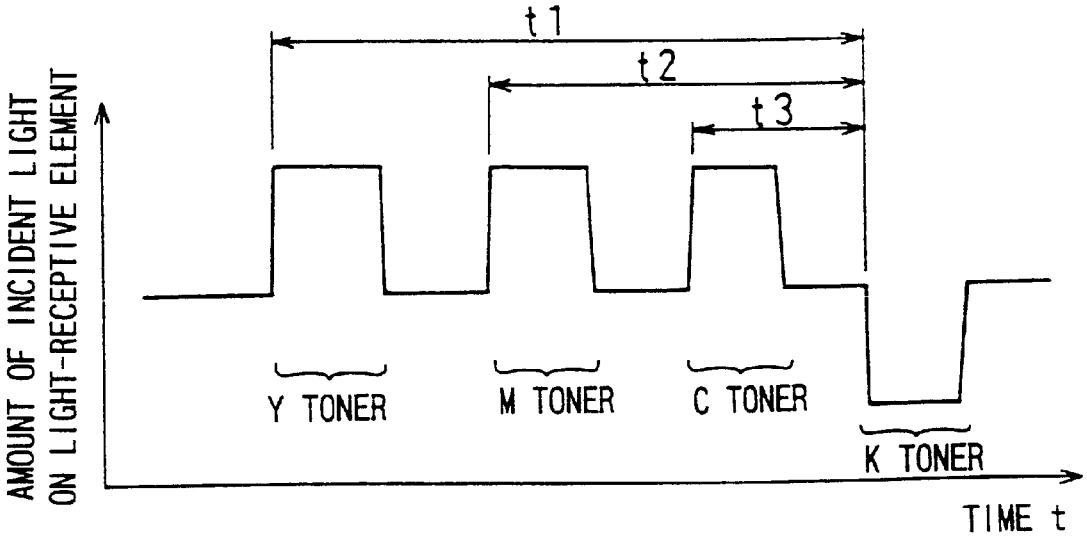
FIG. 7B PRIOR ART

FIG. 6 shows a positional relationship between light-emitting and light-receiving elements of a toner misregistration detection sensor in the case of detecting the toner formed on a black belt shaped transfer medium 13. The toner density and the toner misregistration can be detected by the following method. The optical axes of an infrared light-emitting diode 10 and two photodiodes 11 and 12, are located so as to intersect each other at a point on a transfer medium 10 in a black belt-shape, the photodiode 11 is located on a place receiving only a diffusing and reflecting light, and the photodiode 12 is located on a mirror-reflected place by the infrared light-emitting diode 10, thereby the detected current is detected by using the same circuit as the signal detection circuit. In this case, the above mentioned pattern may be utilized for the pattern for toner density and toner misregistration detection.

Further, the toner misregistration detection sensor of the invention detects the toner density and toner misregistration of the toner adhered to the photosensitive drum. The toner density and toner misregistration may be detected by detecting the toner adhered to the transferring drum (intermediate transfer member), instead of the photosensitive drum.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner misregistration detection sensor for use in a color image forming apparatus, comprising:

a light emitting element for irradiating a predetermined area on an object to be detected with light;

a light receiving element for receiving reflection light which is emitted from the light emitting element and reflected on a surface of the object to be detected;

toner density detection means for detection of toner density based on a signal outputted from the light receiving element;

toner misregistration detection means for detection of toner misregistration based on a signal outputted from the light receiving element; and a signal processing circuit constituting the toner density detection means and the toner misregistration detection means is composed of two amplifiers, one of which is a first step amplifier using a CMOS or an FET operation amplifier and the other is a second step amplifier using a bipolar operation amplifier, and the first step amplifier is provided with a sensitivity adjustment volume.

2. The toner misregistration detection sensor of claim 1, wherein the first step amplifier is a CMOS operation amplifier.

3. The toner misregistration detection sensor of claim 2, wherein the toner misregistration detection means detects a misregistration of each of yellow toner, magenta toner and cyan toner to black toner.

4. The toner misregistration detection sensor of claim 3, wherein the toner misregistration detection means detects a misregistration of a pattern of each of yellow toner, magenta toner and cyan toner, to a pattern of black toner.

5. The toner misregistration detection sensor of claim 4, wherein the toner misregistration detection means detects a misregistration of a pattern of each of yellow toner, magenta toner and cyan toner to a pattern of black toner which are placed so as to be misregistered from each other by half of a width of either of the patterns.

6. The toner misregistration detection sensor of claim 3, wherein the toner misregistration detection means detects a misregistration of a pattern of each of yellow toner, magenta toner and cyan toner to a pattern of black toner, which patterns are disposed so as to form stripes arranged at regular intervals.

7. The toner misregistration detection sensor of claim 3, wherein the toner misregistration detection means detects a misregistration of a pattern of each of yellow toner, magenta toner and cyan toner to a pattern of black toner which is disposed so as to overlap part of the pattern of each of the color toner.

8. The toner misregistration detection sensor of claim 3, wherein the toner misregistration detection means detects a misregistration of a pattern of each of yellow toner, magenta toner and cyan toner to a pattern of black toner which is disposed so as to be partly overlapped by the pattern of each of the color toners.

9. The toner misregistration detection of claim 2, wherein the light emitting element is composed of a light-emitting diode, whose anode is connected to a driving power, and whose cathode is connected to a connector provided for controlling a current.

10. The toner misregistration detection sensor of claim 2, comprising:

one light emitting element for irradiating a predetermined area on an object to be detected with light; and one light receiving element for receiving reflection of light which is emitted from the light-emitting element and is reflected on a surface of the object to be detected, wherein axes of the elements are crossed each other at a point of an object to be detected, and wherein the light-receiving element is located at a position where a mirror reflected component of the light which is emitted from the light-emitting element and reflected on a surface of the object to be detected is not received.

11. The toner misregistration detection sensor of claim 2, comprising:

one light emitting element for irradiating a predetermined area on an object to be detected with light; and two light receiving elements for receiving reflection of light which is emitted from the light-emitting element and is reflected on a surface of the object to be detected, wherein axes of the elements are crossed each other at a point of an object to be detected, and wherein one of the light-receiving elements is located at a position where a mirror reflected component of the light which is emitted from the light-emitting element and reflected on a surface of the object to be detected is not received and the other of the light-receiving elements is located at a position where a mirror reflected component of the light which is emitted from the light-emitting element and reflected on a surface of the object to be detected is received.

12. A color image forming apparatus using the toner misregistration detection sensor of claim 2.

13. The toner misregistration detection sensor of claim 1, wherein feedback of an output from the toner density detection means is carried out to an output from the toner misregistration detection means.

14. The toner misregistration detection sensor of claim 1, wherein a constant voltage circuit is provided to supply standard voltages of the first step amplifier and the second step amplifier.

15. The toner misregistration detection sensor of claim 1, wherein the first step amplifier is an FET operation amplifier.

16. The toner misregistration detection sensor of claim 15, wherein the toner misregistration detection means detects a misregistration of each of yellow toner, magenta toner and cyan toner to black toner.

17. The toner misregistration detection sensor of claim 16, wherein the toner misregistration detection means detects a misregistration of a pattern of each of yellow toner, magenta toner and cyan toner, to a pattern of black toner.

18. The toner misregistration detection sensor of claim 17, wherein the toner misregistration detection means detects a misregistration of a pattern of each of yellow toner, magenta toner and cyan toner to a pattern of black toner which are placed so as to be misregistered from each other by half of a width of either of the patterns.

19. The toner misregistration detection sensor of claim 16, wherein the toner misregistration detection means detects a misregistration of a pattern of each of yellow toner, magenta toner and cyan toner to a pattern of black toner, which patterns are disposed so as to form stripes arranged at regular intervals.

20. The toner misregistration detection sensor of claim 16, wherein the toner misregistration detection means detects a misregistration of a pattern of each of yellow toner, magenta toner and cyan toner to a pattern of black toner which is disposed so as to overlap part of the pattern of each of the color toner.

21. The toner misregistration detection sensor of claim 16, wherein the toner misregistration detection means detects a misregistration of a pattern of each of yellow toner, magenta toner and cyan toner to a pattern of black toner which is disposed so as to be partly overlapped by the pattern of each of the color toners.

22. The toner misregistration detection sensor of claim 15, wherein feedback of an output from the toner density detection means is carried out to an output from the toner misregistration detection means.

23. The toner misregistration detection sensor of claim 15, wherein a constant voltage circuit is provided to supply standard voltages of the first step amplifier and the second step amplifier.

24. The toner misregistration detection of claim 15, wherein the light emitting element is composed of a light-emitting diode, whose anode is connected to a driving power, and whose cathode is connected to a connector provided for controlling a current.

25. The toner misregistration detection sensor of claim 15, comprising:

one light emitting element for irradiating a predetermined area on an object to be detected with light; and one light receiving element for receiving reflection of light which is emitted from the light-emitting element and is reflected on a surface of the object to be detected, wherein axes of the elements are crossed each other at a point of an object to be detected, and wherein the light-receiving element is located at a position where a mirror reflected component of the light which is emitted from the light-emitting element and reflected on a surface of the object to be detected is not received.

26. The toner misregistration detection sensor of claim 15, comprising:

one light emitting element for irradiating a predetermined area on an object to be detected with light; and two light receiving elements for receiving reflection of light which is emitted from the light-emitting element and is reflected on a surface of the object to be detected, wherein axes of the elements are crossed each other at a point of an object to be detected, and wherein one of the light-receiving elements is located at a position where a mirror reflected component of the light which is emitted from the light-emitting element and reflected on a surface of the object to be detected is not received and the other of the light-receiving elements is located at a position where a mirror reflected component of the light which is emitted from the light-emitting element and reflected on a surface of the object to be detected is received.

27. A color image forming apparatus using the toner misregistration detection sensor of claim 15.

28. A method for detection of toner misregistration for use in a color image forming apparatus, comprising:

disposing a pattern of a toner of each color of yellow, magenta and cyan and a pattern of black toner so as to partly overlap each other;

irradiating the patterns with light; and detecting a misregistration of one to the other of patterns based on an amount of light received with a signal processing circuit constituting a toner density detection means and a toner misregistration detection means, the circuit being composed of two amplifiers, one of which is a first step amplifier using a CMOS or an PET operation amplifier and the other being a second step amplifier using a bipolar operation amplifier, and the first step amplifier being provided with a sensitivity adjustment volume.

* * * * *